US005265587A

United States Patent [19]

Carlson

[11] Patent Number: 5,265,587

[45] Date of Patent: Nov. 30, 1993

[54] RECIPROCATING STOVE GRATE ALLOWING AIR FLOW THERETHROUGH

[76] Inventor: Timothy R. Carlson, 20149-44th Ave. NE., Seattle, Wash. 98155

[21] Appl. No.: 858,556

[22] Filed: Mar. 27, 1992

[51] Int. Cl.[5] ..... F23H 7/04

[52] U.S. Cl. ..... 126/174; 110/281; 110/282; 110/283; 126/542

[58] Field of Search ..... 126/1, 542, 174, 175; 110/281, 282, 283, 284, 300

[56] References Cited

U.S. PATENT DOCUMENTS 2,116,322 5/1938 Muir et al. ..... 126/174 X
2,694,990 11/1954 Klijzing et al. .
2,879,727 3/1959 Walters .
2,932,264 4/1960 Hurst .
4,384,535 5/1983 McKelvie et al. .
4,385,566 5/1983 Harris .
4,537,140 8/1985 Baker .
4,665,840 5/1987 Yarnell .
4,840,130 6/1989 Quiel .
4,984,560 1/1991 Hazard ..... 126/174 X

FOREIGN PATENT DOCUMENTS 2894 of 1875 United Kingdom .

*Primary Examiner*—Edward G. Favors
*Attorney, Agent, or Firm*—Graybeal Jackson Haley & Johnson

[57] ABSTRACT .

An apparatus for preventing ash build-up and clinker formation of a particulate fuel mass in a stove includes a grate having a plurality of openings therein and on which the particulate fuel mass resides. A bottomless container retains the particulate fuel mass on the grate. The grate is reciprocated with respect to the bottomless container and the particulate fuel mass such that the position of the grate openings is altered relative to the particulate fuel mass to channel stove air flow through various portions of the particulate fuel mass.

26 Claims, 5 Drawing Sheets

RECIPROCATING STOVE GRATE ALLOWING AIR FLOW THERETHROUGH

BACKGROUND OF THE INVENTION

The invention pertains to stove grates that prevent ash build-up and clinker formation of a particulate fuel mass in a stove. More particularly, the present invention pertains to reciprocating stove grates having orifices therein that allow air flow through the grate in order to prevent ash build-up and clinker formation.

In general, suspension burning is a technique known in the art that is employed to physically suspend difficult to combust material in the air in order to improve the combustion. However, the air flow employed in suspension burning is not used for ash removal or as an impediment to clinker formation. Also known is a shaker grate that has bars that can be agitated or pivotally displaced in order to break-up clinker. However, the shaker grate does not prevent the formation of ash or clinker, it only loosens clinker that has already formed.

U.S. Pat. No. 2,932,264 issued to Hurst discloses a stoker having a movable grate with a plurality of openings therein. The grate is inclined, with a coal hopper disposed at one end. A coal bed covers the grate, which is very slowly reciprocated. The coal bed moves as a unit with the grate and the openings therein as the grate moves to the left (as shown in FIG. 2 of Hurst). This allows additional coal from the hopper to be fed onto the right side of the grate. Then, as the grate moves to the right, part of the coal bed is forced against the rear wall of the hopper such that the coal bed moves left relative to the rightward movement of the grate, thus pushing coal ash off of the left end of the grate. The purpose of the reciprocating grate of Hurst is to feed coal, not the efficient burning of lower quality pellets by ash dissipation through the grate holes which prevents clinker formation. In fact, Hurst admits clinker formation at column 3, lines 3 through 8, and expressly avoids removal of ash through the grate holes at column 3, lines 15 through 18. Finally, the grate of Hurst does not reciprocate in both directions under a stable fuel mass, but instead the grate moves with the moving coal bed in a first direction and moves in the opposite direction of the coal bed in a second direction.

U.S. Pat. No. 4,537,140 issued to Baker; U.S. Pat. No. 4,665,840 issued to Yarnell; and U.S. Pat. No. 2,879,727 issued to Walters all disclose non-moving fuel grates having holes therein. The Baker patent discloses a feed system whereby the grate receives fuel from a movable carpet. Both the Yarnell and Walters patents disclose grates that are gravity fed.

A need thus exists for a stove grate that prevents ash build-up and clinker formation of low quality particulate fuel during burning in a pellet stove or the like.

A need exists for the above type of grate in which a plurality of openings therein allow air flow through the grate in order to prevent ash build-up and clinker formation.

A need also exists for the above type of grate having openings therein in which the grate reciprocates relative to the particulate fuel mass to channel a constant stream of stove air flow through various portions of the particulate fuel mass in order to prevent ash build-up and clinker formation.

Finally, a need exists for the above type of reciprocating grate having openings therein in which few moving parts are required to cause reciprocation of the grate.

SUMMARY OF THE INVENTION

An apparatus for preventing ash build-up and clinker formation of a particulate fuel mass in a stove is disclosed. The apparatus includes a grate having a plurality of openings therein and on which the particulate fuel mass resides. The openings are preferably rows of spherical orifices or slits, either staggered or laterally aligned.

A bottomless container retains the particulate fuel mass on the grate. The grate is reciprocated with respect to the bottomless container and the particulate fuel mass such that the position of the grate openings is altered relative to the particulate fuel mass to channel stove air flow through various portions of the particulate fuel mass. The grate has a dimension parallel with its direction of reciprocation that is greater than the corresponding dimension of the bottomless container so that particulate fuel does not escape from the container during grate reciprocation.

Reciprocation of the grate is caused by an assembly including a drive rod attached to the grate that is slidable along its longitudinal axis. A collar is attached to an end of the drive rod and a cam is located within the collar. Rotation of the cam by a motor urges the collar sequentially in opposite directions resulting in reciprocation of the drive rod along its longitudinal axis as well as reciprocation of the grate.

BRIEF DESCRIPTION OF THE DRAWINGS

These and other features of the present invention will be evident when considered in light of the following specification and drawings in which.

A DETAILED DESCRIPTION OF THE PREFERRED EMBODIMENT

The grate apparatus 2 of the present invention is adapted to be located in a stove for burning particulate matter such as, for example, pellets, particles, chaff, chips, or pieces of combustibles in either a residential or industrial configuration. An example of such a stove in which grate apparatus 2 may be configured is disclosed in U.S. Pat. No. 4,941,414 issued to Carlson on July 17, 1990, which is incorporated herein by reference.

Figure 1:
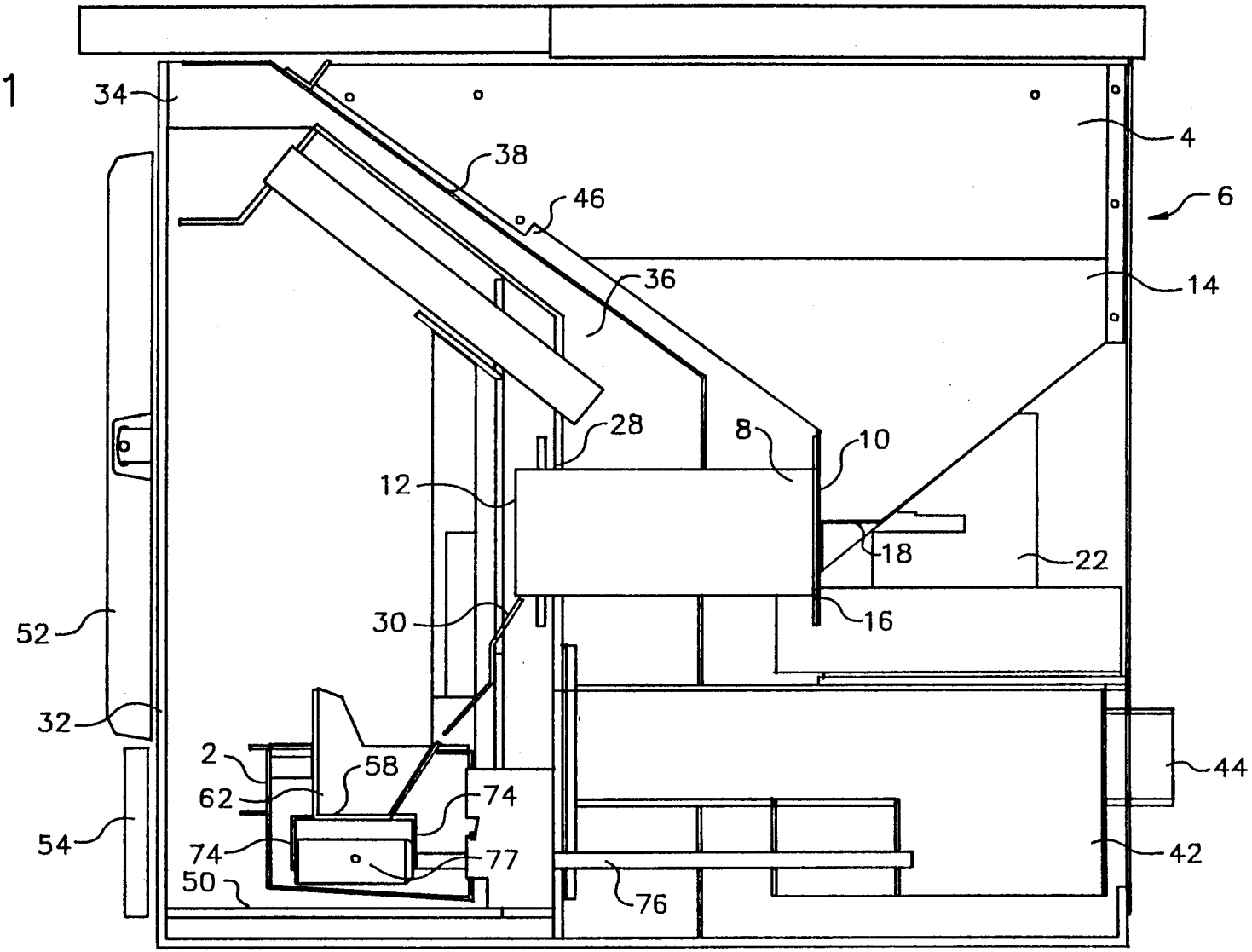
FIG. 1 is an exposed side view of an exemplary stove employing the grate apparatus of the present invention.
Figure 2:
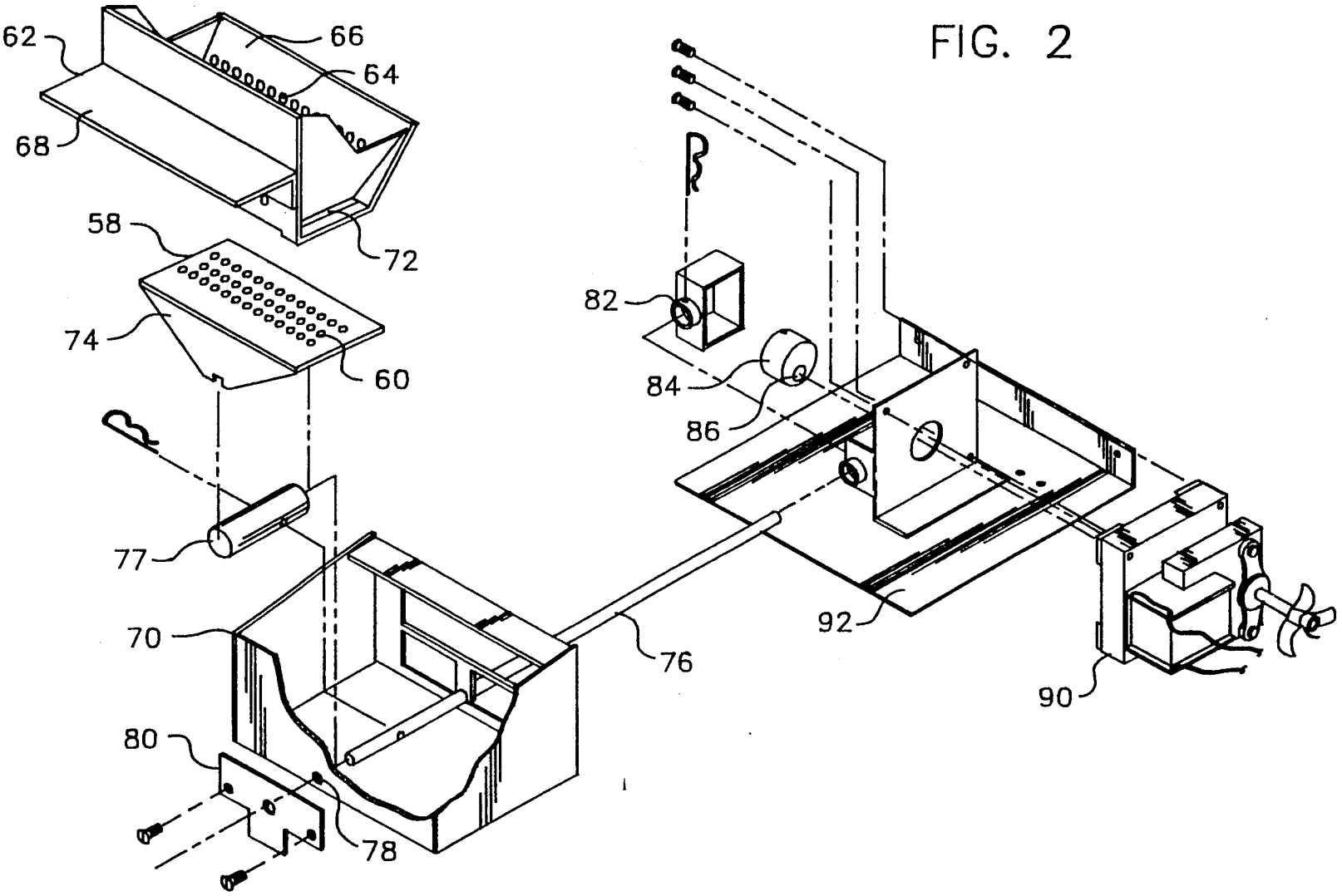
FIG. 2 is an exploded perspective view of the grate apparatus of the present invention.
Figure 3:
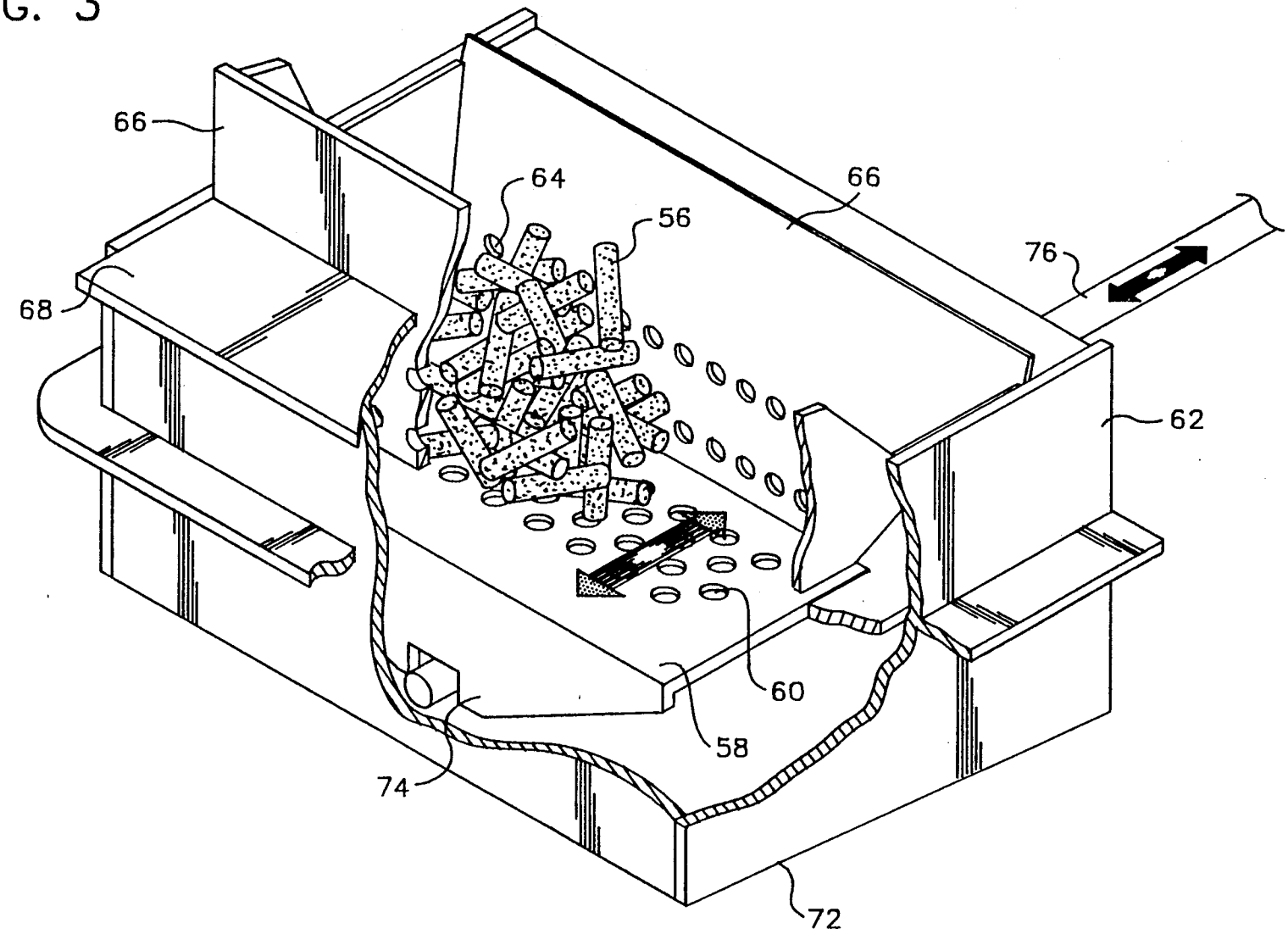
FIG. 3 is a detailed perspective view of the grate and fuel container of grate apparatus of the present invention.
Figure 4:
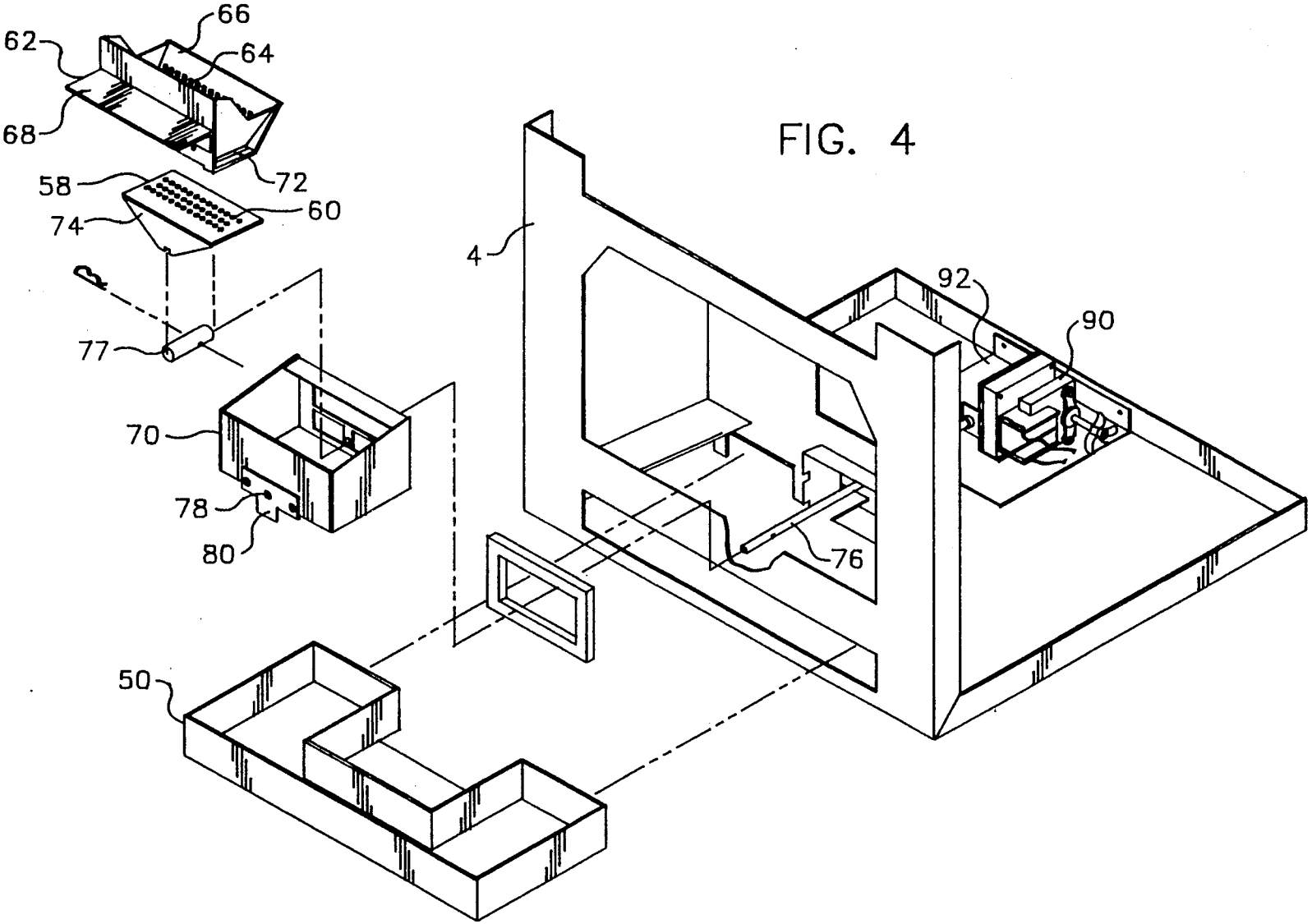
FIG. 4 is an exploded perspective view of the grate apparatus of the present invention on a portion of an exemplary stove.
Figure 5:
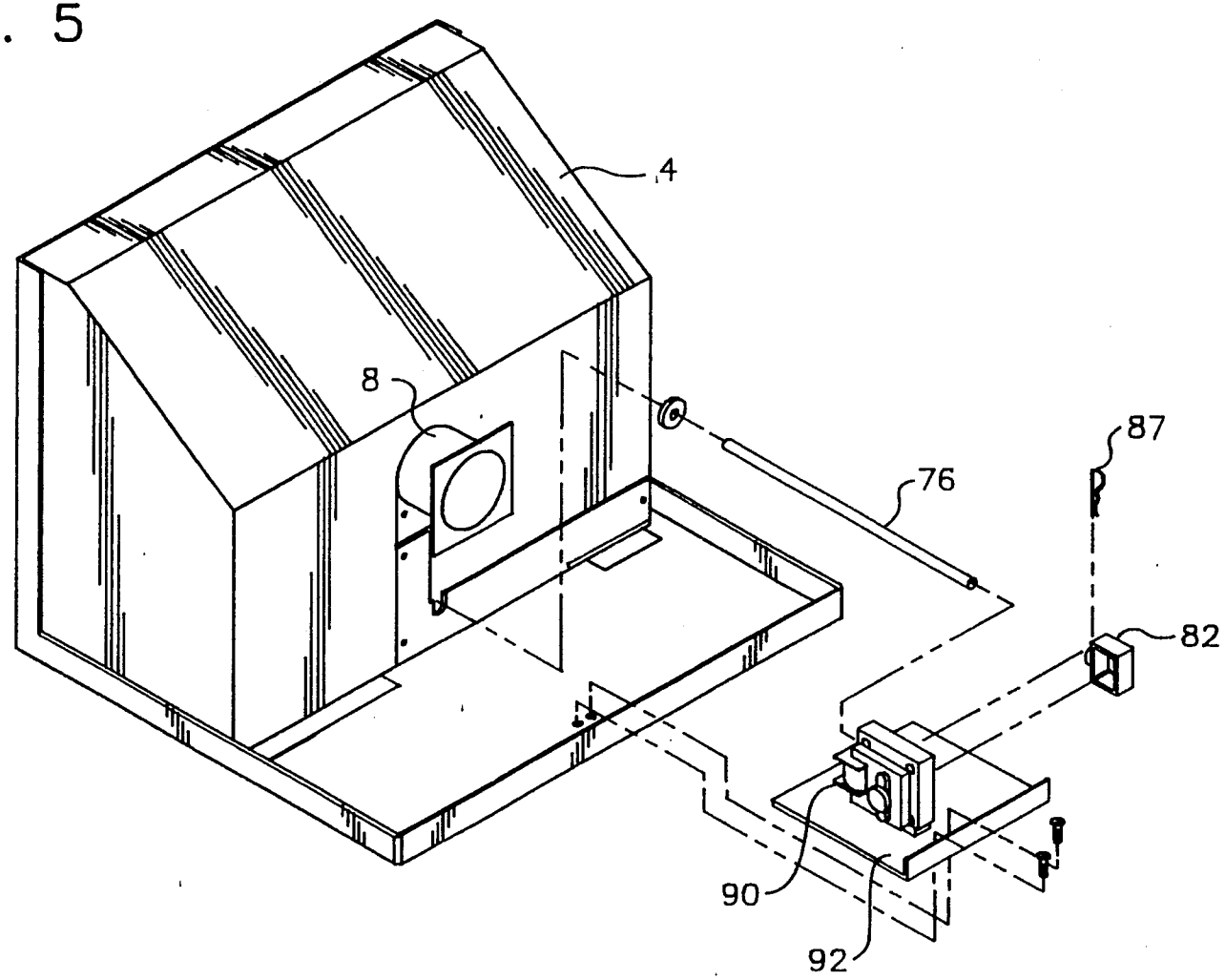
FIG. 5 is an exploded perspective view of the grate apparatus of the present invention and an exemplary stove.

As shown in FIG. 1, an exemplary stove 4 includes a pellet feed system 6 having a hollow feed cylinder 8 with an upstream end 10 and a downstream end 12. At the upstream end 10, adjacent the connection with hopper 14, feed cylinder 8 is journaled in gasket bearing 16. A drive rod 18 is located within upstream end 10 and is attached to drive 22. Drive 22 includes a gear assembly and drive motor known in the art. The downstream end 12 of cylinder 8 is journaled in another gasket bearing 28 and communicates with pellet discharge chute 30. Chute 30 is located between feed cylinder 8 and firebox 32 of stove 4.

Above firebox 32 are convection air tubes 34 which join convection plenum 36, located behind firebox 32. Air plenum wall 38 is adjacent to convection plenum 36. Exhaust fan 42 vents air from stove 4 by exhaust exit 44. Insulation blanket 46 is located between air plenum wall 38 and hopper 14 and provides shielding of these components from thermal energy. Firebox 32 also includes a combustion air inlet adjacent to grate apparatus 2. Ash pan 50 is under grate apparatus 2 and collects ash from the particulate fuel mass. Firebox door 52 and ash pan door 54 are located on the front surface of firebox 32. It is readily apparent that the above mentioned stove 4 and accompanying components thereof are merely illustrative of an example of a stove that can be employed with grate apparatus 2. The present invention is not intended to be limited in scope by the configuration of stove in which it is employed.

Referring now to FIGS. 2 through 5, grate apparatus 2 includes grate 58 on which can rest particulate fuel mass 56. Grate 58 includes a plurality of openings 60 therein. Openings 60 may be spherical, ovoid or slit in shape, and may be configured in rows that are either staggered or laterally aligned. In sum, openings 60 may be of any desired shape and the configuration of openings 60 on grate 58 may be of any desired configuration as long as openings 60 uniformly channels a substantially constant stream of air flow intermittently to all of the various portions of the underside of particulate fuel mass 56 upon reciprocation of grate 58 as detailed below.

Fuel container 62 is a walled structure lacking a top and bottom and preferably having vent orifices 64 in one or more of its sides 66. Lip 68 is located on a side 66 of fuel container 62 and removably attaches fuel container 62 to exterior box 70 such that fuel container 62 is stable relative to reciprocation of grate 58. The dimension of grate 58 that is parallel with its direction of reciprocation (for example, the width of grate 58) is greater than the corresponding dimension (i.e. width) of bottom opening 72 of fuel container 62 so that pieces of particulate fuel mass 56 do not escape from between fuel container 62 and grate 58 during reciprocation of grate 58.

Grate 58 includes platform 74 which fixedly attaches grate 58 to drive rod 76 in exterior box 70. Specifically, drive lug 77 is secured to drive rod 76 by a pin or the like such that drive lug 77 is braced between platform 74 of grate 58. In this manner, reciprocation of drive rod 76 causes reciprocation of grate 58, discussed in further detail below. Drive rod 76 passes through exterior box 70 and through drive rod opening 78 in exterior box 70. One end of drive rod 76 passes through guide flange 80 adjacent to exterior box 70 and attached to firebox 32. Fuel container 62 sits in exterior box 70 on lip 60 and in contact with grate 58. Lip 68 allows fuel container 62 to reside on exterior box 70 in a stationary manner during reciprocation of grate 58, and also allows fuel container 62 to be removed for cleaning.

The end of drive rod 76 not passing through guide flange 80 includes collar 82. Cam 84 resides within collar 82 such that cam shaft 86 is offset within collar 82. Cam shaft 86 and cam pin 87 connect cam 84 to drive motor 88, which is secured to firebox 32 by motor mount 90 and frame 92.

In operation, rotation of cam shaft by actuation of the drive motor 90 results in rotation of cam 84 in either a clockwise or counterclockwise direction within collar 82. Because drive rod 76 is longitudinally slidable, the rotation of cam 84 results in longitudinal reciprocation of drive rod 76 relative to firebox 32, exterior box 70 and fuel container 62 as cam 84 is urged against collar 82. This longitudinal reciprocation of drive rod 76 results in reciprocation of grate 58 in, for example, a direction parallel with the width of grate 58, due to the attachment of grate 58 to drive rod 76. It should be noted, however, that reciprocation of grate 58 may be, for example, in a direction parallel to the length of grate 58 or may be in a circular or substantially circular pattern.

The above described reciprocation of grate 58 occurs under a substantially stable non-moving particulate fuel mass 56 such that position of the openings 60 of grate 58 is altered relative to the substantially stable particulate fuel mass, thus uniformly channeling the substantially constant stove air flow intermittently through substantially all portions of the underside of the particulate fuel mass. This stove air flow may be air circulated in the stove by convection air tubes 34 and exhaust fan 42 in a manner traditionally known in the art. The stove air flow passes through the underside of grate 58 by means of openings 60. The lighter ash on the particulate fuel mass 56 is carried upwardly by the air flow and away from particulate fuel mass 56. The ash on particulate fuel mass 56 which is too heavy to be carried upwardly by the air flow is loosened from particulate mass 56 by the air flow through openings 60 of grate 58 such that the ash falls through openings 60 and into ash pan 50. The above mentioned reciprocation of grate 58 ensures that ash on substantially all of particulate fuel mass 56 is removed, thus preventing clinker formation. "Clinker" is known to those skilled in the art as the fusing of the particulate fuel mass 56 due to the presence of ash thereon at high burning temperatures.

The above described reciprocation of grate 58 may result in slight agitation of the particles of particulate fuel mass 56 in order to further hinder ash deposition and clinker formation. However, this slight agitation is not intended to encompass vigorous, violent motion of the particles of particulate fuel mass 56 such that these particles are physically separated from particulate fuel mass 56. Additionally, reciprocation of grate 58 may result in physical movement of particulate mass 56 due to contact of particulate fuel mass 56 with one of sides 66 of fuel container 62 as grate 58 reciprocates alternately in, for example, a left-handed and a right-handed direction relative to fuel container 62.

The above described embodiments are intended to be descriptive, not restrictive. The full scope of the invention is described by the claims, and any and all equivalents are included.

I claim:

1. An apparatus for preventing ash build-up and clinker formation of a particulate fuel mass in a stove, said apparatus comprising:

grate adapted to support the particulate fuel and having a plurality of openings therein, said openings allowing passage of stove air flow from under said grate through the particulate fuel mass; and means for reciprocating said grate relative to the particulate fuel mass such that the position of said plurality of openings is altered relative to the particulate fuel mass to channel stove air flow through various portions of the particulate fuel mass, said means for reciprocating comprising a drive rod attached to said grate, said drive rod slidable along its longitudinal axis, a collar on said guide rod, a cam in said collar, and motor means for rotation of said cam whereby rotation of said cam urges said collar sequentially in opposite directions resulting in reciprocation of said drive rod along its longitudinal axis and reciprocation of said grate.

2. The apparatus of claim 1 wherein said means for reciprocating said grate causes grate reciprocation sufficient to agitate the particulate fuel mass.

3. The apparatus of claim 1 wherein said plurality of openings are spherical in shape and are aligned in rows.

4. The apparatus of claim 3 wherein said rows are staggered.

5. The apparatus of claim 1 wherein said plurality of openings are slots.

6. The apparatus of claim 5 wherein said slots are disposed parallel with respect to each other.

7. The apparatus of claim 5 wherein some of the said slots are disposed aparallel with respect to the remainder of said slots.

8. The apparatus of claim 1 further comprising:

a bottomless container for retaining the particulate fuel mass on said grate, said container being fixed relative to the reciprocation of said grate, the dimension of said grate parallel with the direction of reciprocation of said grate being greater than the corresponding dimension of said container so that said grate reciprocates under the particulate fuel mass without loss of fuel particles from within said container.

9. The apparatus of claim 8 wherein said container includes sides and the particulate fuel mass is forced against said sides of said container upon reciprocation of said grate to agitate the particulate fuel mass.

10. An apparatus for preventing ash build-up and clinker formation of a particulate fuel mass in a stove, said apparatus comprising:

a grate adapted to support the particulate fuel and having a plurality of openings therein, said openings allowing passage of stove air flow from under said grate through the particulate fuel mass;

means for reciprocating said grate relative to the particulate fuel mass such that the position of said plurality of openings is altered relative to the particulate fuel mass to channel stove air flow through various portions of the particulate fuel mass, said means for reciprocating comprising a drive rod attached to said grate, said drive rod slidable along its longitudinal axis, a collar on said guide rod, a cam in said collar, and motor means for rotation of said cam whereby rotation of said cam urges said collar sequentially in opposite directions resulting in reciprocation of said drive rod along its longitudinal axis and reciprocation of said grate; and a bottomless container for retaining the particulate fuel mass on said grate, said container being fixed relative to the reciprocation of said grate.

11. The apparatus of claim 10 wherein said means for reciprocating said grate causes grate reciprocation sufficient to agitate the particulate fuel mass.

12. The apparatus of claim 10 wherein said plurality of openings are spherical in shape and are aligned in rows.

13. The apparatus of claim 12 wherein said rows are staggered.

14. The apparatus of claim 10 wherein said plurality of openings are slots.

15. The apparatus of claim 14 wherein said slots are disposed parallel with respect to each other.

16. The apparatus of claim 14 wherein some of said slots are disposed aparallel with respect to the remainder of said slots.

17. The apparatus of claim 10 wherein said container includes sides and particulate fuel mass is forced against said sides of said container upon reciprocation of said grate to agitate the particulate fuel mass.

18. An apparatus for preventing ash build-up and clinker formation of a particulate fuel mass in a stove, said apparatus comprising:

a grate adapted to support the particulate fuel and having a plurality of openings therein, said openings allowing passage of stove air flow from under said grate through the particulate fuel mass;

a drive rod attached to said grate, said drive rod slidable along its longitudinal axis;

a collar on said guide rod;

a cam in said collar; and motor means for rotation of said cam whereby rotation of said cam urges said collar sequentially in opposite directions resulting in reciprocation of said drive rod along its longitudinal axis and reciprocation of said grate relative to the particulate fuel mass such that the position of said plurality of openings is altered relative to the particulate fuel mass to channel stove air flow through various portions of the particulate fuel mass.

19. The apparatus of claim 18 wherein said grate is reciprocated sufficiently to agitate the particulate fuel mass.

20. The apparatus of claim 18 wherein said plurality of openings are spherical in shape and are aligned in rows.

21. The apparatus of claim 20 wherein said rows are staggered.

22. The apparatus of claim 18 wherein said plurality of openings are slots.

23. The apparatus of claim 22 wherein said slots are disposed parallel with respect to each other.

24. The apparatus of claim 22 wherein some of said slots are disposed aparallel with respect to the remainder of said slots.

25. The apparatus of claim 18 further comprising:

a bottomless container for retaining the particulate fuel mass on said grate, said container being fixed relative to the reciprocation of said grate, the dimension of said grate parallel with the direction of reciprocation of said grate being greater than the corresponding dimension of said container so that said grate reciprocates under the particulate fuel mass without loss of fuel from within said container.

26. The apparatus of claim 25 wherein said container includes sides and the particulate fuel mass is forced against said sides of said container upon reciprocation of said grate to agitate the particulate fuel mass.

* * * * *